US009997120B2

(12) United States Patent
Tanaka et al.

(10) Patent No.: US 9,997,120 B2
(45) Date of Patent: Jun. 12, 2018

(54) DISPLAY DEVICE WITH GATE FLOATING FOR REDUCING FLICKER

(71) Applicant: Japan Display Inc., Tokyo (JP)

(72) Inventors: Yukio Tanaka, Tokyo (JP); Daiichi Suzuki, Tokyo (JP); Kenji Nakao, Tokyo (JP)

(73) Assignee: Japan Display Inc., Tokyo (JP)

( * ) Notice: Subject to any disclaimer, the term of this patent is extended or adjusted under 35 U.S.C. 154(b) by 360 days.

(21) Appl. No.: 14/680,140

(22) Filed: Apr. 7, 2015

(65) Prior Publication Data

US 2015/0287375 A1 Oct. 8, 2015

(30) Foreign Application Priority Data

Apr. 7, 2014 (JP) ..... 2014-078732

(51) Int. Cl.
*G09G 3/36* (2006.01)

(52) U.S. Cl.
CPC ..... *G09G 3/3614* (2013.01); *G09G 3/3648* (2013.01); *G09G 3/3677* (2013.01); *G09G 2310/0202* (2013.01); *G09G 2320/0247* (2013.01); *G09G 2330/021* (2013.01); *G09G 2340/0435* (2013.01)

(58) Field of Classification Search
CPC .. G09G 3/3611; G09G 3/3614; G09G 3/3648; G09G 3/3677; G09G 3/3696; G09G 3/3688; G09G 2310/0202; G09G 2310/0291; G09G 2320/0214; G09G 2320/0219; G09G 2320/0247; G09G 2330/021; G09G 2330/028; G09G 2340/0435
See application file for complete search history.

(56) References Cited

U.S. PATENT DOCUMENTS 7,321,353 B2 1/2008 Tsuda et al.
2001/0052898 A1* 12/2001 Osame ..... G09G 3/3688 345/211
2002/0180673 A1* 12/2002 Tsuda ..... G02F 1/136213 345/87

(Continued)

FOREIGN PATENT DOCUMENTS

JP 2001-312253 A 11/2001
JP 2004-029477 A 1/2004

(Continued)

OTHER PUBLICATIONS

Japanese Office Action dated Feb. 6, 2018 for the corresponding Japanese Patent Application No. 2014-078732.

*Primary Examiner* — Keith Crawley
(74) *Attorney, Agent, or Firm* — Typha IP LLC

(57) ABSTRACT

When an intermittent driving mode is carried out in a TFT using LIPS and α-Si for a pixel transistor, a flicker easily occurs. A display device includes a TFT including a gate, a source, and a drain; a signal line connected to the source; a pixel capacitance connected to the drain; a first power supply configured to supply a potential that breaks electricity conducted between the source and the drain to the gate; and a switch configured to supply a potential of the first power supply to the gate. The display device includes a scan period and a dwell period. The switch is turned on in the scan period, and the switch is turned off in the dwell period.

6 Claims, 18 Drawing Sheets

(56) References Cited

U.S. PATENT DOCUMENTS

| | | | | |
|---|---|---|---|---|
| 2004/0008170 | A1* | 1/2004 | Makino | G09G 3/3651 345/87 |
| 2004/0178977 | A1* | 9/2004 | Nakayoshi | G09G 3/3614 345/87 |
| 2005/0052393 | A1* | 3/2005 | Kobashi | G09G 3/3614 345/96 |
| 2005/0248558 | A1* | 11/2005 | Kobashi | G09G 3/20 345/204 |
| 2011/0148826 | A1* | 6/2011 | Koyama | G09G 3/3696 345/204 |
| 2013/0342481 | A1* | 12/2013 | Small | G06F 3/0412 345/173 |

FOREIGN PATENT DOCUMENTS

| | | | |
|---|---|---|---|
| JP | 2005-0707539 | A | 3/2005 |
| WO | 2001/84226 | A1 | 11/2001 |

* cited by examiner

| | REF | GF1 |
|---|---|---|
| PF | -19. 45% | -4. 06% |
| NF | 0. 78% | -7. 67% |
| AVE | -9. 33% | -5. 87% |
| DIF | -20. 24% | 3. 62% |

| | Vs (IP) | Vs (OV) | Vs (RP) |
|---|---|---|---|
| PF | -1. 72% | -3. 94% | -5. 88% |
| NF | -7. 51% | -9. 22% | -12. 04% |
| AVE | -4. 62% | -6. 58% | -8. 96% |
| DIF | 5. 79% | 5. 28% | 6. 16% |

| | GF3 | REF | GF1 |
|---|---|---|---|
| PF | -4.49% | -19.45% | -4.06% |
| NF | 1.09% | 0.78% | -7.67% |
| AVE | -1.70% | -9.33% | -5.87% |
| DIF | -5.57% | -20.24% | 3.62% |

DISPLAY DEVICE WITH GATE FLOATING FOR REDUCING FLICKER

CLAIM OF PRIORITY

The present application claims priority from Japanese patent application JP2014-078732 filed on Apr. 7, 2014, the content of which is hereby incorporated by reference into this application.

BACKGROUND

The present disclosure relates to a display device, and is applicable to a display device of a low frequency driving mode or intermittent driving mode, for example.

The following is disclosed in Japanese Unexamined Patent Application Publication No. 2001-312253.

In a driving method for a display device in which pixels formed of active devices are disposed in a matrix configuration on a screen, lines on the screen are selected by a plurality of scanning signal lines in order of the lines for scanning and the pixels of the selected line are supplied with a data signal from a data signal line for display, a dwell period is provided. The dwell period is a non-scan period longer than a scan period in which the screen is scanned for one time, and in the dwell period, all the scanning signal lines are turned into a non-scan state. The sum of the scan period and the dwell period is one vertical period. In the dwell period, all the data signal lines are turned into a high-impedance state for a data signal driver that drives all the data signal lines. In the dwell period, all the scanning signal lines are applied with a non-select voltage that turns the OFF resistance value of the active device to almost the maximum.

SUMMARY

The inventors investigate a low frequency driving mode and an intermittent driving mode using low temperature poly-silicon (in the following, referred to as LTPS) and amorphous silicon (in the following, referred to as α-Si) thin film transistors (in the following, referred to as a TFT). However, since the OFF characteristics of LTPS and α-Si TFTs are not better than oxide semiconductor TFTs, a problem arises in that a flicker easily occurs.

Other problems and novel features will be apparent from the description and accompanying drawings of the present disclosure.

In the present disclosure, the following is a brief description of the outline of a representative aspect.

In other words, a display device includes: a TFT including a gate, a source, and a drain; a signal line connected to the source; a pixel capacitance connected to the drain; a first power supply configured to supply a potential that breaks electricity conducted between the source and the drain to the gate; and a switch configured to supply a potential of the first power supply to the gate. The display device includes a scan period, in which one screen is scanned, and a dwell period between the scan period and a subsequent scan period, the dwell period being the same as or longer than the scan period; the switch is turned on in the scan period; and the switch is turned off in the dwell period.

DESCRIPTION OF THE PREFERRED EMBODIMENTS

Figure 1:
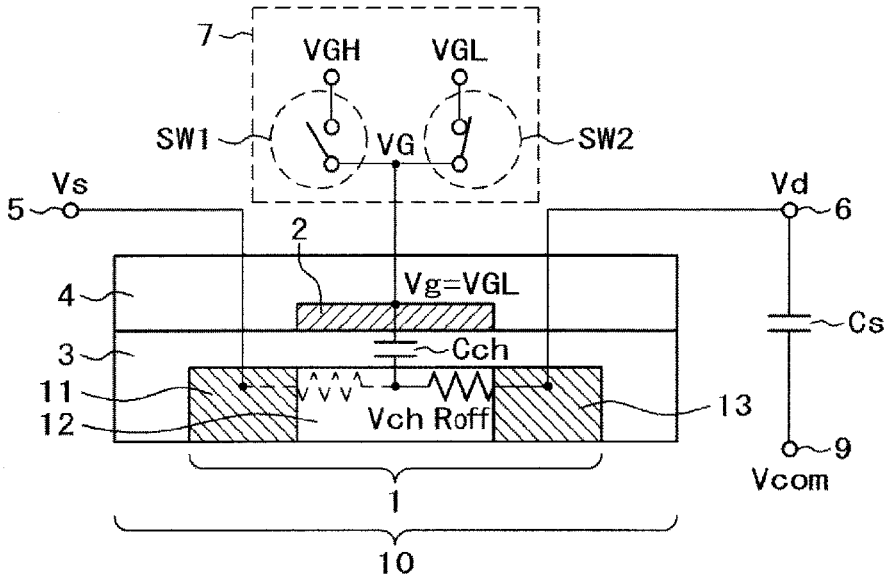
FIG. 1 is a schematic diagram of the configuration of a comparative example form.

It is necessary to decrease the circuit power consumption of display devices for use in mobile devices such as a smartphone and a tablet terminal. For one of schemes for the decrease, the low frequency driving mode, the intermittent driving mode, and the like are proposed. The low frequency driving mode is a mode in which the drive frequency of a display device is decreased to a half or a quarter of the drive frequency, for example, with respect to the normal conditions and circuit electric power is decreased. Moreover, the intermittent driving mode is a mode in which data is written in one display period (a scan period) of a display device, a circuit halt period (a dwell period) that is one display period or longer is provided, and circuit electric power is decreased. In both cases, since the picture signal rewrite period of the display unit is increased, a side effect such as blurs of moving images is possibly taken place. However, in the case where still images and the like are displayed, which the visibility of moving images is not important, the modes are effective schemes for decreasing circuit electric power. It is noted that in the following, in the low frequency driving mode and the intermittent driving mode, a time interval for rewriting the picture signal of a pixel is referred to as "a frame period" or "one frame", and the reciprocal of the time interval is referred to as "a frame frequency". Furthermore, a period after data is written in a scan period and before data is written in the subsequent scan period is referred to as a hold period. In the intermittent driving mode, the hold period includes the dwell period.

In an active matrix display device, in the hold period after data is written, TFTs formed on pixels are turned into the OFF-state, and the charge of a pixel electrode is held. When the OFF characteristics of the TFT configuring this pixel transistor are not excellent, the charge is lost during the hold period, the voltage value after the hold period is different from the initial value, and the luminance is changed. After the luminance is changed, such a phenomenon appears that the luminance is changed when data is rewritten, and a flicker is visually recognized. In the low frequency driving mode and the intermittent driving mode, an important parameter is the OFF characteristics, that is, how long the charge during the hold period can be reliably held for a long time.

In these years, for a material of excellent OFF characteristics, attention is focused on oxide semiconductors (for example, IGZO that is an oxide formed of In (indium), Ga (gallium), and Zn (zinc)), and an active matrix display device using an oxide semiconductor is also announced. However, generally, in a high definition active matrix display device such as a smartphone, a LIPS TFT is often used. This is because of merits that the TFT size can be decreased and a logic circuit such as a scanning circuit can also be formed on an array substrate (a TFT substrate), and it can be thought that the LIPS TFT will be a mainstream in future.

In the following, an embodiment, a comparative example, examples, and exemplary modifications will be described with reference to the drawings. It is noted that the present disclosure is merely an example, and appropriate modifications that can be easily conceived by a person skilled in the art within the teachings of the present invention are of course included in the scope of the present invention. Moreover, for clear description, the width, thickness, shape, and the like of components are sometimes schematically depicted in the drawings as compared with the actual forms. However, these are merely examples, and do not limit the interpretation of the present invention. Furthermore, in the specification and the drawings, components similar to ones already described are designated the same reference numerals and signs, and the detailed description is sometimes appropriately omitted.

When a LIPS TFT is used for a pixel transistor and the intermittent driving mode is carried out, a problem arises in that a luminance change (a flicker) occurs as described above. This is caused by the fact that a leakage current due to the OFF current decreases the charge of the pixel electrode. It is thought that since poly-silicon has crystallizability higher than the crystallizability of α-Si, the OFF characteristics of the TFT are not excellent, and a current is easily leaked.

As for the leakage of the LIPS TFT, two modes are known: (a) a relaxation phenomenon between the drain electrode (or the pixel electrode) and the gate electrode; and (b) a leakage current leaked from the drain (or the pixel electrode) to the source (or a signal line). Generally, in the case where a leakage current is referred, this often means (b). However, the inventors analyzed that (a) is not difficult to ignore, and it becomes apparent that it is necessary to take some measures to decrease (a).

<The Relaxation Phenomenon Between the Drain Electrode and the Gate Electrode>

A description will be made on (a) the relaxation phenomenon between the drain electrode and the gate electrode in a technique studied prior to the present disclosure (in the following, referred to as a comparative example) with reference to FIGS. 1 and 2. It is noted that in the specification, the potential is expressed as the center of a picture signal range is a reference (0 V).

FIG. 1 is a schematic diagram of the configuration of a comparative example form. FIG. 2 is a diagram of the potential waveforms of the comparative example form.

A TFT 10 includes a semiconductor layer 1 formed of poly-silicon, a gate electrode 2, and a gate insulating film 3 provided between the semiconductor layer 1 and the gate electrode 2. It is noted that an interlayer insulating film 4 is formed on the gate electrode 2 and the gate insulating film 3. The semiconductor layer 1 includes a source 11, a poly-silicon channel 12, and a drain 13. The source 11 is connected to a signal line 5, the drain 13 is connected to a pixel electrode 6, and the gate electrode 2 is connected to a gate power supply circuit 7. Here, the output potential of the gate power supply circuit 7 is denoted as VG, the potential (the gate potential) of the gate electrode 2 is denoted as Vg, the potential (the signal potential) of the signal line 5 is denoted as Vs, the potential (the pixel potential) of the pixel electrode 6 is denoted as Vd, and the potential (the channel potential) of the poly-silicon channel 12 is denoted as Vch.

First, in the case where a switch SW2 is turned OFF, a switch SW1 is turned ON, and VG (=Vg) is at a high potential (VGH), the TFT 10 is in a conducting state, and the signal potential (Vs) is transmitted to the source 11, the poly-silicon channel 12, the drain 13, and the pixel electrode 6, and the potentials are Vch=Vd=Vs, regardless of a positive frame or a negative frame. Here, since a resistance component between the source 11 and the signal line 5 is ignored, the potential (the source potential) of the source 11 is Vs. Moreover, when a resistance component between the drain 13 and the pixel electrode 6 is ignored, the potential (the drain potential) of the drain 13 is Vd. In other words, as expressed by an arrow A1 in FIG. 2, both of Vch(+) and Vd(+) are charged to Vs(+) when data is written, and both of Vch(−) and Vd(−) are charged to Vs(−). Here, in FIG. 2, Vs(+) is a signal potential on the positive side (when a frame is a positive frame), and Vs(−) is a signal potential on the negative side (when a frame is a negative frame). Vch(+) is a channel potential on the positive side, and Vch(−) is a channel potential on the negative side. Vd(+) is a pixel potential on the positive side, and Vd(−) is a pixel potential on the negative side.

Figure 2:
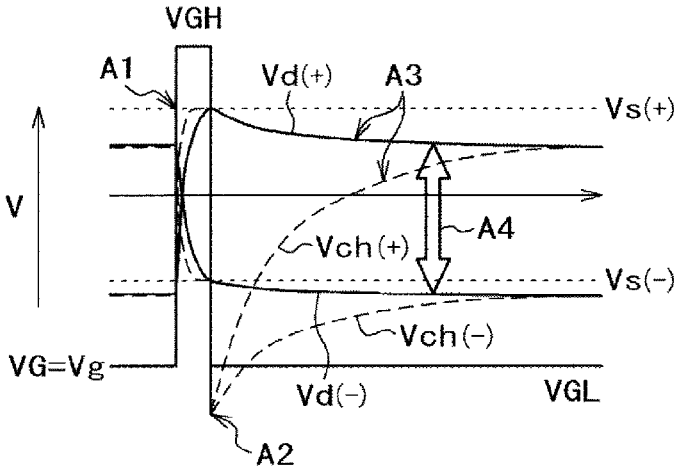
FIG. 2 is a diagram of the potential waveforms of the comparative example form.

Next, as illustrated in FIG. 1, the switch SW1 is turned OFF, the switch SW2 is turned ON, VG (=Vg) is shifted from VGH to a low potential (VGL), and the TFT 10 is turned to a non-conducting state (the OFF-state), as expressed by an arrow A2 in FIG. 2, Vch(+) and Vch(−) are greatly decreased because of the influence of coupling of a capacitance Cch between the gate electrode 2 and the poly-silicon channel 12, and Vch(+) and Vch(−) are nearly at the potential (VGL−Vth). Here, Vth is the threshold voltage of the TFT 10. On the other hand, since a large capacity pixel capacitance Cs is connected to the drain 13, Vd(+) and Vd(−) are hardly changed at the moment at which the TFT 10 is turned OFF. The pixel capacitance Cs is formed of the pixel electrode 6 and a counter electrode 9, and a common potential (Vcom) is applied to the counter electrode 9. Therefore, a potential difference occurs between Vch(+) and Vd(+) and between Vch(−) and Vd(−).

The poly-silicon channel 12 is not always in an ideal resistance infinite state in the OFF-state of the TFT 10, and includes a leakage resistance component Roff. Since Vg=VGL is maintained in the dwell period, electric charges are reallocated between the capacitance Cs and the capacitance Cch through the leakage resistance component Roff. Therefore, as expressed by arrows A3 in FIG. 2, Vch(+) and Vch(−) are increased, Vd(+) and Vd(−) are dropped, and the potentials are becoming equal. It is noted that electric charges are also reallocated between the source potential (Vs) and Vch, but the reallocation is ignored here. This is a phenomenon known as a relaxation phenomenon between the drain electrode and the gate electrode, and the time constant is generally an order of few tens microseconds to a few seconds.

As illustrated in FIG. 2, immediately after the switch SW2 is turned ON, the potentials are in the relation (Vd(+)−Vch(+))>(Vd(−)−Vch(−)), and the drop of Vd caused by the relaxation phenomenon between the drain electrode and the gate electrode is taken place more noticeably in the positive frame than in the negative frame. Therefore, as expressed by an arrow A4 in FIG. 2, the amplitude of the hold voltage (Vd(+)−Vd(−)) between the positive frame and the negative frame is decreased over time, and the luminance of liquid crystals is decreased. Thus, a flicker occurs.

<First Gate Floating Form>

The inventors investigated various gate floating forms for measures to decrease the relaxation phenomenon between the drain electrode and the gate electrode. First, a first gate floating form will be described with reference to FIGS. 3 and 4.

Figure 3:
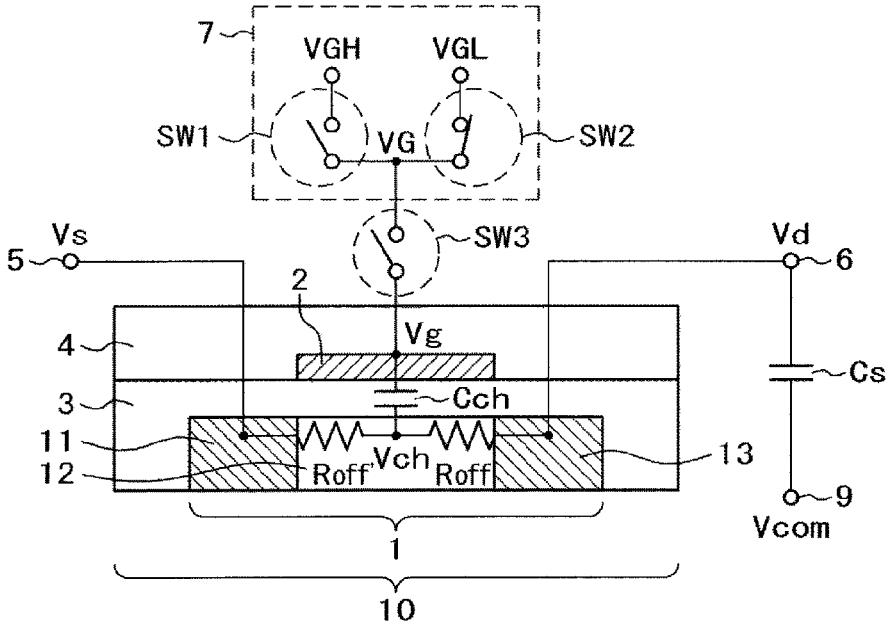
FIG. 3 is a schematic diagram of the configuration of a first gate floating form.
Figure 4:
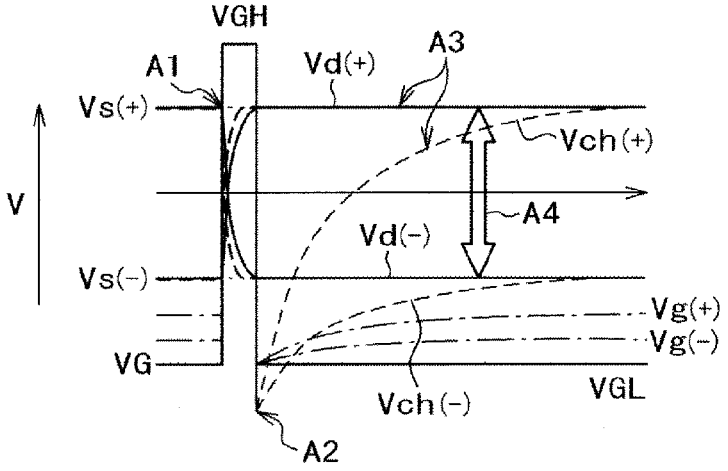
FIG. 4 is a diagram of the potential waveforms of the first gate floating form.

FIG. 3 is a schematic diagram of the configuration of the first gate floating form. FIG. 4 is a diagram of the potential waveforms of the first gate floating form.

Although the configuration of a TFT of the first gate floating form is the same as the TFT of the display device according to the comparative example, the connection to the gate power supply circuit 7 is different. In the first gate floating form, a switch SW3 is disposed between a gate power supply circuit 7 and a gate electrode 2. Here, similarly to the display device according to the comparative example, VG is the output potential of the gate power supply circuit 7, Vg is the potential (the gate potential) of the gate electrode 2, Vs is the potential (the signal potential) of a signal line 5, Vd is the potential (the pixel potential) of a pixel electrode 6, and Vch is the potential (the channel potential) of a poly-silicon channel 12. In the following, the operation of the first gate floating form will be described.

The operation is the same as the operation in FIG. 2 until the potential Vg of the TFT 10 is shifted from VGH to VGL. In other words, arrows A1 and A2 in FIG. 4 are the same as the operations expressed by the arrows A1 and A2 in FIG. 2. Here, in FIG. 4, Vs(+) is a signal potential on the positive side (when a frame is a positive frame), and Vs(−) is a signal potential on the negative side (when a frame is a negative frame). Vch(+) is a channel potential on the positive side, and Vch(−) is a channel potential on the negative side. Vd(+) is a pixel potential on the positive side, and Vd(−) is a pixel potential on the negative side. Vg(+) is a gate potential on the positive side, and Vg(−) is a gate potential on the negative side.

The first gate floating form is a form in which in the dwell period after the TFT 10 is turned OFF, the switch SW3 is turned OFF, the gate electrode 2 of the TFT 10 is disconnected from the gate power supply circuit 7, and the gate electrode 2 is electrically floated. When this configuration is provided, a capacitance Cch is an isolated capacitance in the dwell period, electric charges are stored, and no electric current is generated in the capacitance Cch. Therefore, suppose that an electric current carried between a source 11 and the poly-silicon channel 12 through a leakage resistance component Roff' can be ignored, no electric current is carried through a leakage resistance component Roff as well. Therefore, the charge amount accumulated on a capacitance Cs is stored as well, and Vd also becomes constant. As expressed by arrows A3 in FIG. 4, Vch(+) and Vd(+) become equal, and Vch(−) and Vd(−) become equal in the dwell period. However, since Vg is not fixed, the potential equalization is achieved under the conditions in which Vd(+) and Vd(−) are at constant and only Vch(+) and Vch(−) are increased. At this time, since the hold voltage of the capacitance Cch is at constant, Vg(+) and Vg(−) are increased as well in association with increases in Vch(+) and Vd(−). As expressed by an arrow A4 in FIG. 4, the amplitude of the hold voltage (Vd(+)−Vd(−)) between the positive frame and the negative frame is kept at constant. Since the pixel potential (Vd) is at constant, the transmittance of liquid crystals also becomes constant, and a flicker is suppressed.

Problems of the first gate floating form will be described with reference to FIGS. 5 to 8.

Figures 5, 6:
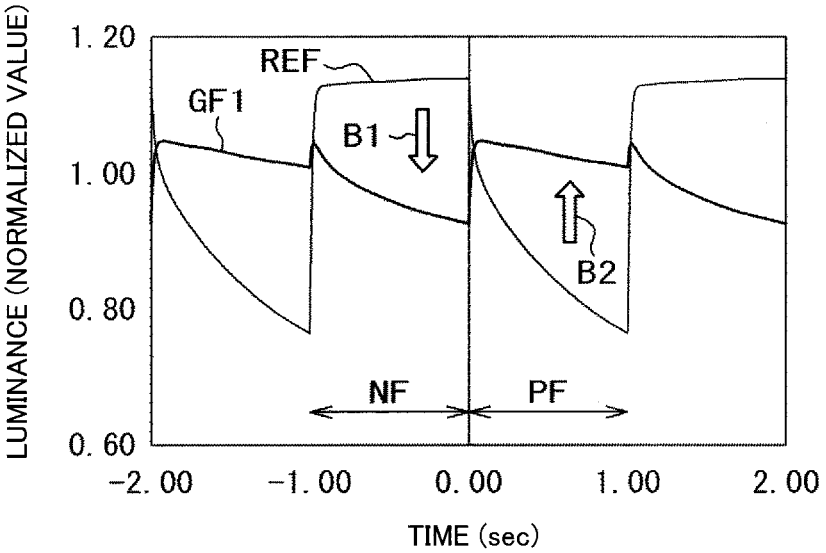
FIG. 5 is a diagram of the luminance response waveforms of the comparative example form and the first gate floating form.
FIG. 6 is a diagram of the luminance change rates of the comparative example form and the first gate floating form.
Figure 7:
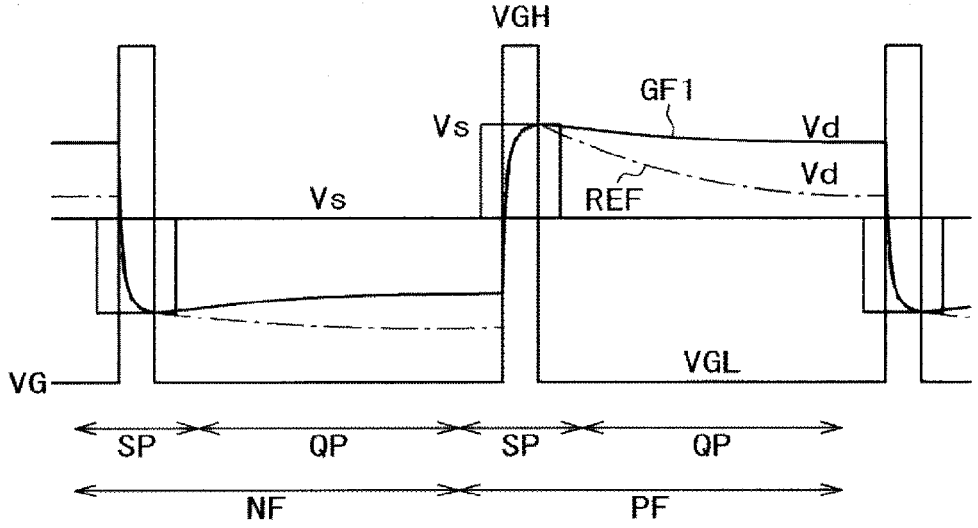
FIG. 7 is a diagram of the potential waveforms of the comparative example form and the first gate floating form.
Figure 8:
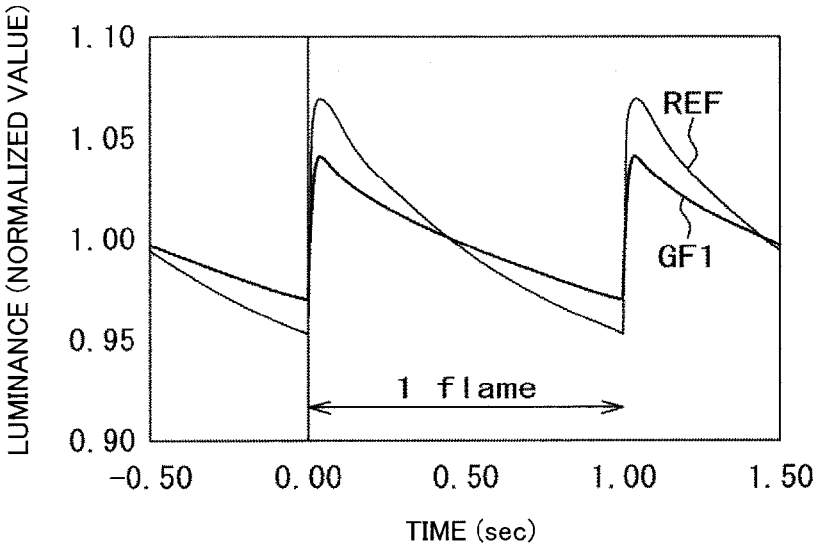
FIG. 8 is a diagram of luminance response waveforms that symmetric components are extracted from the luminance response waveforms in FIG. 5.

FIG. 5 is a diagram of the luminance response waveforms of the comparative example and the first gate floating form. FIG. 6 is a diagram of the luminance change rates of the comparative example and the first gate floating form. FIG. 7 is a diagram of the potential waveforms of the comparative example and the first gate floating form. FIG. 8 is a diagram of luminance response waveforms that symmetric components are extracted from the luminance response waveforms in FIG. 5.

FIG. 5 is an example of the luminance response waveforms that a liquid crystal display device is actually operated in the comparative example form (FIG. 1) and the first gate floating form (FIG. 3). In the comparative example form (REF), such tendencies are observed that the luminance is slightly increased in the negative frame (NF) and the luminance is noticeably dropped in the positive frame (PF). In the first gate floating form (GF1), such a tendency is observed that the luminance is moderately dropped in both of the negative frame and the positive frame. As illustrated in FIG. 6, the luminance change rate of the first gate floating form in the positive frame is −4.06%, which is greatly decreased as compared with the luminance change rate of the comparative example form that is −19.45%. On the other hand, the luminance change rate of the first gate floating form in the negative frame (NF) is −7.67%, which is greater than the luminance change rate of the comparative example form that is 0.78%. The average (a symmetric component, AVE) of the luminance in the positive frame and the luminance in the negative frame in the first gate floating form is −5.87%, which is decreased as compared with the average of the comparative example form that is −9.33%. The difference (an antisymmetric component, DIF) between the positive frame and the negative frame in the first gate floating form is 3.62%, which is greatly decreased as compared with the difference in the comparative example form that is −20.24%. As expressed by an arrow B1 and an arrow B2 in FIG. 5, the luminance is closer to 1.00 in the first gate floating form than in the comparative example form. Therefore, the antisymmetric component (the difference between the luminance in the positive frame and the luminance in the negative frame) of the luminance response in the positive frame and the negative frame in the first gate floating form is more decreased than in the comparative example form.

FIG. 7 is an estimation of fluctuations in the pixel potential based on the waveforms in FIG. 5. The positive frame (PF) and the negative frame (NF) are formed of the scan period (SP) and the dwell period (QP). In the dwell period, the signal potential (Vs) is fixed to zero volt. When an estimation is made in consideration that fluctuations in the pixel potential and fluctuations in the luminance have opposite signs in the negative frame and have the same signs in the positive frame, in the comparative example form (REF), it can be estimated that such tendencies are observed that the pixel potential (Vd) is slightly dropped in the negative frame and Vd is noticeably dropped in the positive frame. Moreover, in the first gate floating form (GF1), such tendencies are observed that Vd is moderately increased in the negative frame and Vd is moderately dropped in the positive frame. In these estimations, the pixel potential depicted in FIG. 2 is surely observed in the comparative example form (REF). However, in the first gate floating form, the pixel potential is not at constant as illustrated in FIG. 4.

In the actual liquid crystal display device, in order to perform driving such as column inversion, dot inversion, and line inversion, macroscopically, regions in which pixels in the positive frame and in the negative frame are mixed half are observed. Therefore, the luminance response that is the average of the positive frame and the negative frame is observed.

FIG. 8 is waveforms (symmetric components) that are the average of the positive frame and the negative frame from the luminance response waveforms illustrated in FIG. 5. Although fluctuations in the luminance are surely decreased because the form is switched from the comparative example form (REF) to the first gate floating form (GF1), the waveforms are not completely flat as illustrated in FIG. 4 (the luminance is at constant).

<Second Gate Floating Form>

A possibility can be thought that the reason why the experimental result in the first gate floating form is not as illustrated in FIG. 4 is caused by the fact that it is not possible to actually ignore the influence of the electric current carried between the source 11 and the poly-silicon channel 12 through the leakage resistance component Roff', which is ignored in the description in the first gate floating form described above. In this case, since it can be thought that the leakage current is affected by the source potential (the signal potential) in the dwell period, experiments were carried out in order to confirm the influence.

The fact that the leakage current is affected by the source potential and a second gate floating form will be described with reference to FIGS. 9 to 12.

Figure 9:
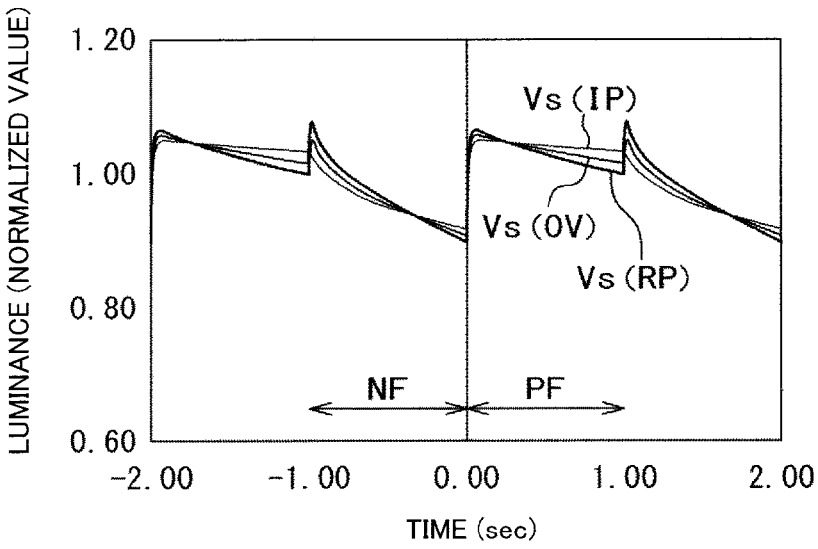
FIG. 9 is a diagram of the luminance response waveforms of a second gate floating form.
Figures 10, 11:
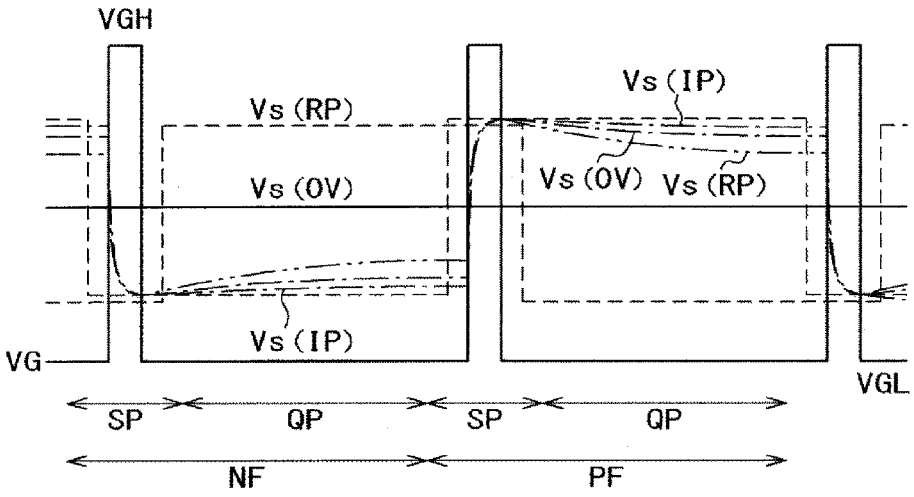
FIG. 10 is a diagram of the luminance change rates of the second gate floating form.
FIG. 11 is a diagram of the potential waveforms of the second gate floating form.
Figure 12:
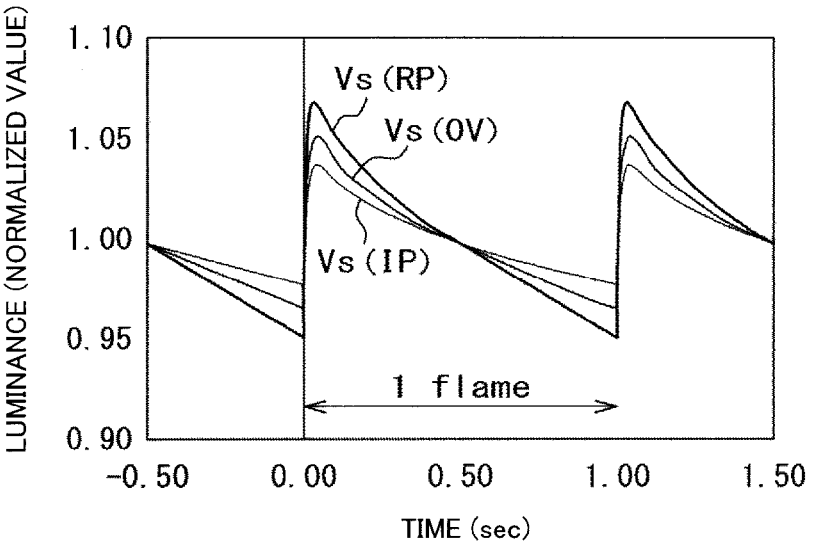
FIG. 12 is a diagram of luminance response waveforms that symmetric components are extracted from the luminance response waveforms in FIG. 9.

FIG. 9 is a diagram of the luminance response waveforms of the second gate floating form. FIG. 10 is a diagram of the luminance change rates of the second gate floating form. FIG. 11 is a diagram of the potential waveforms of the second gate floating form. FIG. 12 is a diagram of luminance response waveforms that symmetric components are extracted from the luminance response waveforms in FIG. 9.

Experiments were carried out in three ways: (a) the source potential in the dwell period (QP) is held at the same value as Vs when data is written (referred to as "the same phase" or "Vs (IP)"); (b) the source potential in the dwell period is held at zero volt (referred to as "0 V" or "Vs (0 V)"); and (c) the source potential in the dwell period is held at a potential that the sign is opposite to the sign of Vs when data is written and the absolute value is the equal value (referred to as "a reversed phase" or "Vs (RP)"). FIG. 9 is the measured result of the luminance response waveforms at this time. It is shown that both in the negative frame (NF) and the positive frame (PF), the slope of the luminance change is the greatest in the case of the reversed phase and the slope of the luminance change becomes gentler in order of the reversed phase, 0 V, and the same phase. As illustrated in FIG. 10, the luminance change rate of Vs (IP) in the positive frame (PF) is −1.72%, which is decreased as compared with −3.94% at Vs (0 V) and −5.88% at Vs (RP). The luminance change rate of Vs (IP) in the negative frame is −7.51%, which is decreased as compared with −9.22% at Vs (0 V) and −12.04% at Vs (RP). The average luminance (the symmetric component, AVE) of the luminance of Vs (IP) in the positive frame (PF) and in the negative frame (NF) is −4.62%, which is decreased as compared with −6.58% at Vs (0 V) and −8.96% at Vs (RP). Therefore, the slope of the luminance of the symmetric component (AVE) of Vs (IP) is decreased.

FIG. 11 is an estimation of fluctuations in the pixel potential based on the luminance response waveforms in FIG. 9. It can be interpreted that as illustrated in FIG. 11, fluctuations in the pixel potential are surely varied according to the source potential in the dwell period. It is noted that the gate potential (Vg) is fixed to VGH or VGL in the scan period (SP).

Moreover, FIG. 12 is a diagram of extractions of symmetric components corresponding to the luminance from FIG. 9 in macroscopically visual observation. It can be observed that the slope of the luminance change is also the greatest in the case of the reversed phase here and the slope of the luminance change becomes gentler in order of the reversed phase, 0 V, and the same phase.

From the description above, the involvement of the electric current carried between the source 11 and the poly-silicon channel 12 through the leakage resistance component Roff' surely exists.

Consequently, in the second gate floating form, the source potential in the dwell period is held in phase with Vs when data is written. Accordingly, it is possible to suppress fluctuations in the luminance (a flicker). It is noted that the source potential in the dwell period is held at the potential in the same polarity, not the same potential as Vs when data is written, which can also exert the effect of suppressing a flicker as compared with the case where the source potential is held at zero volt.

<Third Gate Floating Form>

A third gate floating form will be described with reference to FIGS. 13 to 16.

Figure 13:
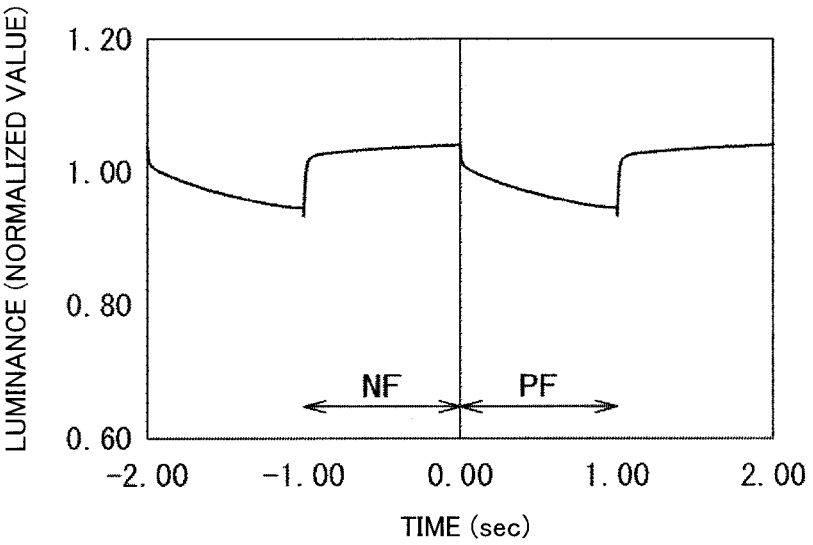
FIG. 13 is a diagram of the luminance response waveforms of a third gate floating form.
Figures 14, 15:
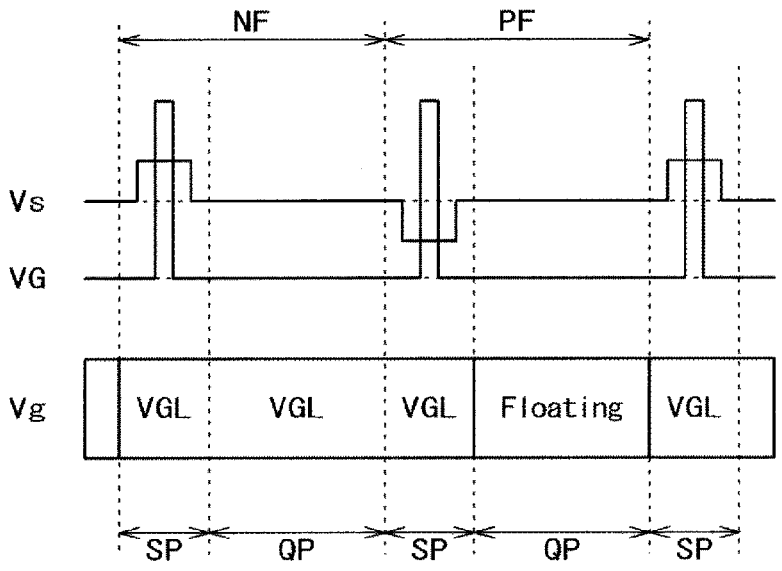
FIG. 14 is a diagram of the luminance change rates of the third gate floating form.
FIG. 15 is a diagram of the potential waveforms of the third gate floating form.
Figure 16:
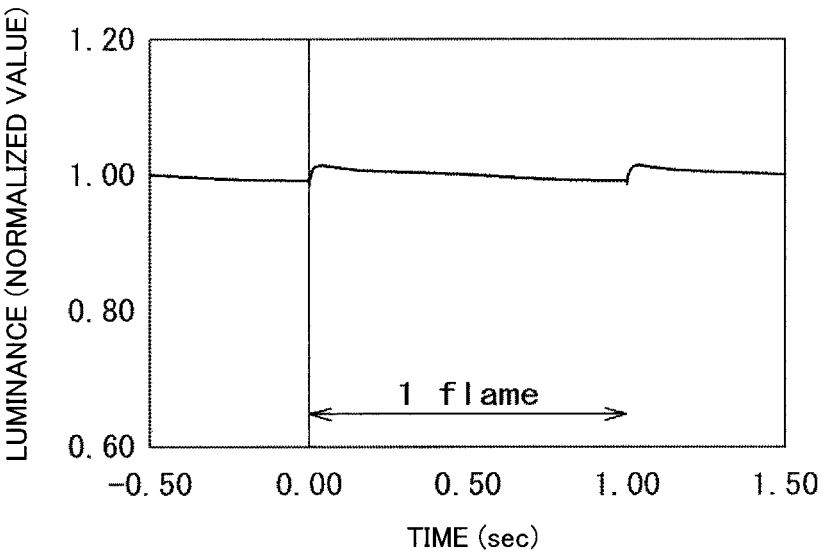
FIG. 16 is a diagram of luminance response waveforms that symmetric components are extracted from the luminance response waveforms in FIG. 12.

FIG. 13 is a diagram of the luminance response waveforms of the third gate floating form. FIG. 14 is a diagram of the luminance change rates of the third gate floating form. FIG. 15 is a diagram of the potential waveforms of the third gate floating form. FIG. 16 is a diagram of luminance response waveforms that symmetric components are extracted from the luminance response waveforms in FIG. 13.

As illustrated in FIG. 15, the third gate floating form (GF3) is in which in the dwell period (QP) in the negative frame (NF), the gate potential (Vg) is fixed to VGL and the gate potential (Vg) is floated only in the dwell period (QP) in the positive frame (PF). As described above, the form is switched from the comparative example form to the first gate floating form, and such tendencies are observed that the luminance change rate is greatly improved in the positive frame, (the luminance change rate is prone to be dropped but the absolute value of the change rate is decreased), which the luminance change rate is noticeably dropped in the positive frame in the comparative example form, whereas the luminance change rate in the negative frame is dropped, which is slightly increased in the comparative example form. In other words, from the viewpoint of suppressing the tendency that the luminance change rate as the average of the positive frame and the negative frame is dropped, the behavior in the negative frame in the first gate floating form is rather an adverse effect. Therefore, the gate is floated for the gate potential in the dwell period only in the positive frame in which the effect of improvement is great, and the gate potential in the dwell period is fixed in the negative frame, so that the tendency that the absolute value of the luminance change rate as the average of the positive frame and the negative frame is dropped can be at the minimum. Actually, as illustrated in FIGS. 13 and 14, the behaviors of the luminance response waveforms and the luminance change rate in the positive frame are similar to the behaviors in the first gate floating form (GF1), the behaviors of the luminance response waveforms and the luminance change rate in the negative frame are similar to the behaviors in the comparative example form (REF), and the luminance response waveforms (the symmetric components) as the average of the positive frame and the negative frame is nearly flat as illustrated in FIG. 16, so that a flicker can be greatly improved.

In the display device according to the embodiment, any one of operations (1) to (5) below is carried out in the intermittent driving mode, so that a flicker can be decreased.

(1) The gate potential is floated in the dwell period ((a) a scheme against the relaxation phenomenon between the drain electrode and the gate electrode).

(2) The source potential in the dwell period is optimized ((b) a scheme against a leakage current leaked from the drain to the source).

(3) The gate potential is floated in the dwell period and the source potential in the dwell period is optimized ((a) and (b)).

(4) The gate potential is floated only in the dwell period in the positive frame ((a)).

(5) The gate potential is floated only in the dwell period in the positive frame and the source potential in the dwell period is optimized ((a) and (b)).

As described above, although the intermittent driving mode is described, the schemes (1) and (4) are also applicable to the hold period in the low frequency driving mode.

Also in a high definition display device using LTPS TFTs, a flicker can be suppressed. Thus, a small-sized LTPS can be used, so that a decrease in backlight electric power by a high aperture ratio or a narrow picture frame can be combined with a decrease in circuit power consumption by the low frequency driving mode or the intermittent driving mode. It is without saying that it is fine to apply the embodiment to a display device using α-Si TFTs because the OFF characteristics of α-Si are excellent more than in poly-silicon but not excellent more than in oxide semiconductors. It is noted that although the OFF characteristics of oxide semiconductors are excellent more than in α-Si, the embodiment can also be applied to a display device using oxide semiconductor TFTs.

It is noted that the display device according to the embodiment is applicable to liquid crystal display devices of a so-called vertical electric field mode such as liquid crystal display devices driven in a TN (Twisted Nematic) mode, VA (Vertical Alignment) mode, or MVA (Multi-domain Vertical Alignment) mode and to liquid crystal display devices of a lateral electric field mode such as liquid crystal display devices driven in an IPS (In-Plane Switching) mode, a FFS (Fringe Field Switching) mode, and the like. However, in the following, display devices according to examples will be described as a liquid crystal display device of an FFS mode is a representative one.

First Example

A display device according to a first example will be described with reference to FIGS. 17 to 21.

Figure 17:
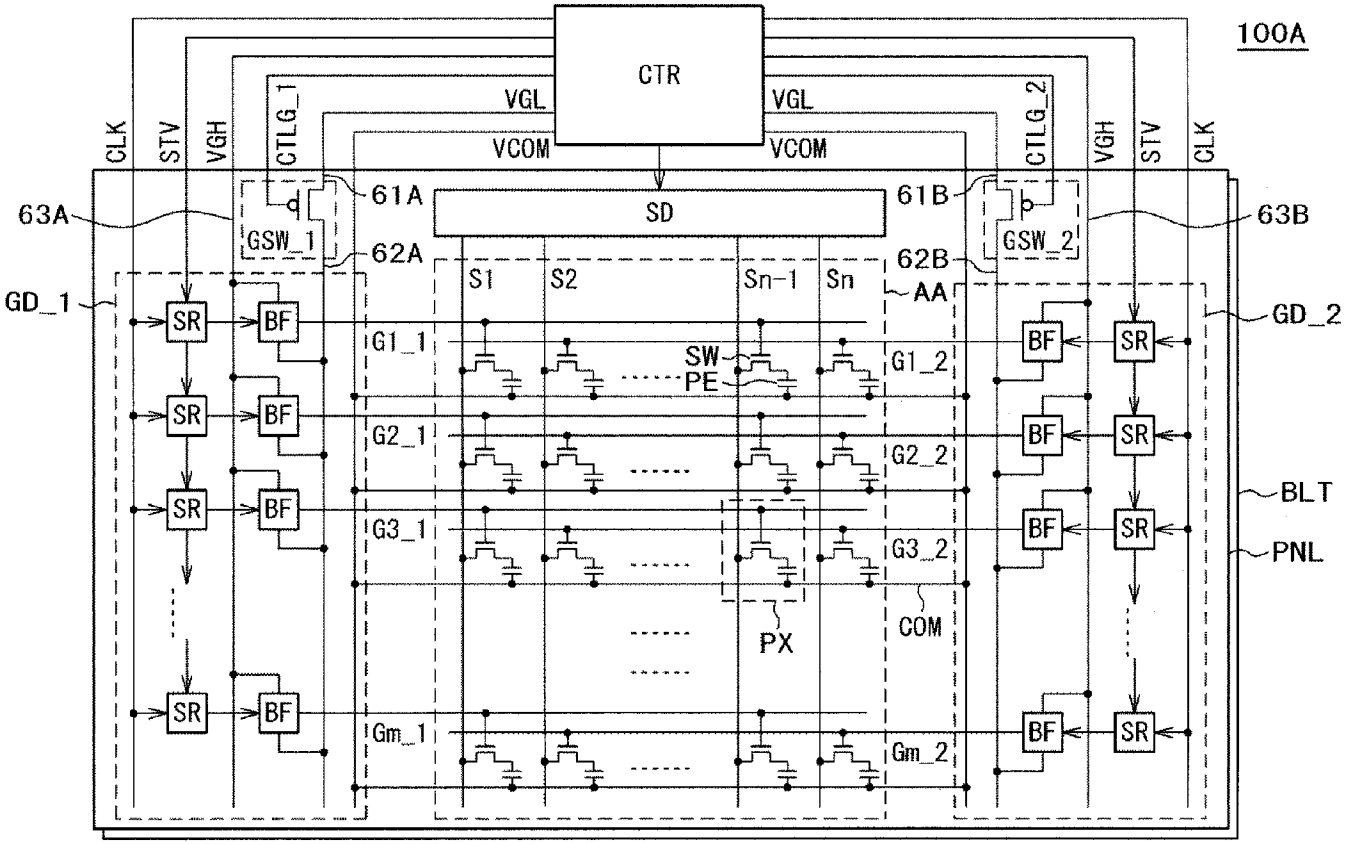
FIG. 17 is a diagram of the configuration of a display device according to a first example.
Figure 18:
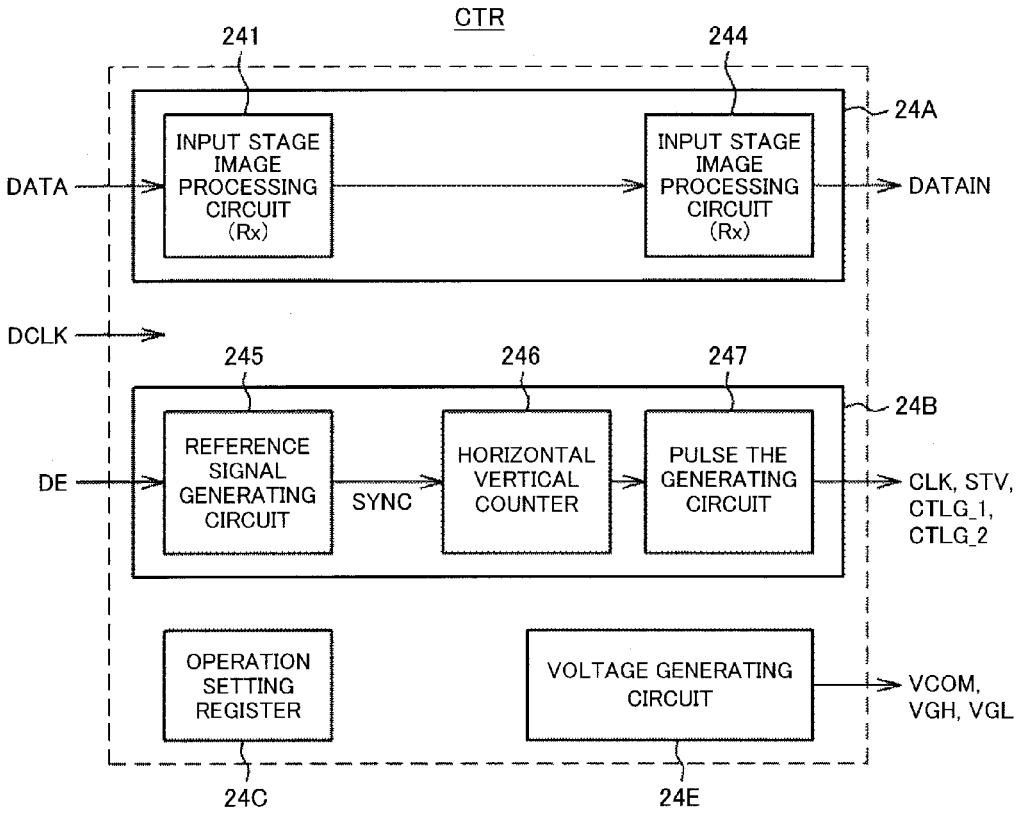
FIG. 18 is a block diagram of a control circuit according to the first example.
Figure 19:
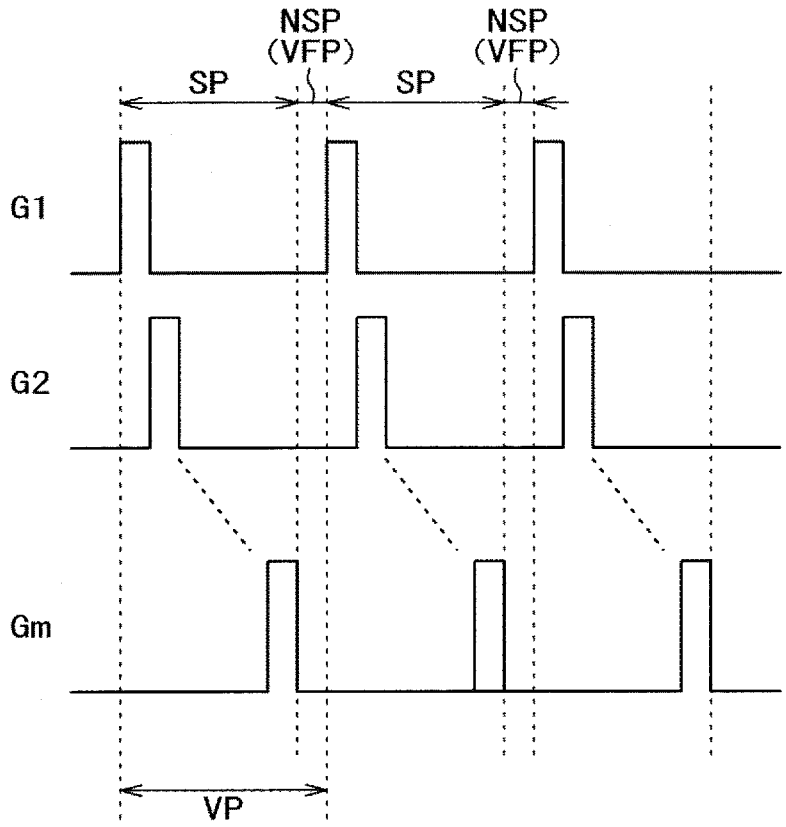
FIG. 19 is a timing chart illustrative of a driving method for the display device according to the first example.
Figure 20:
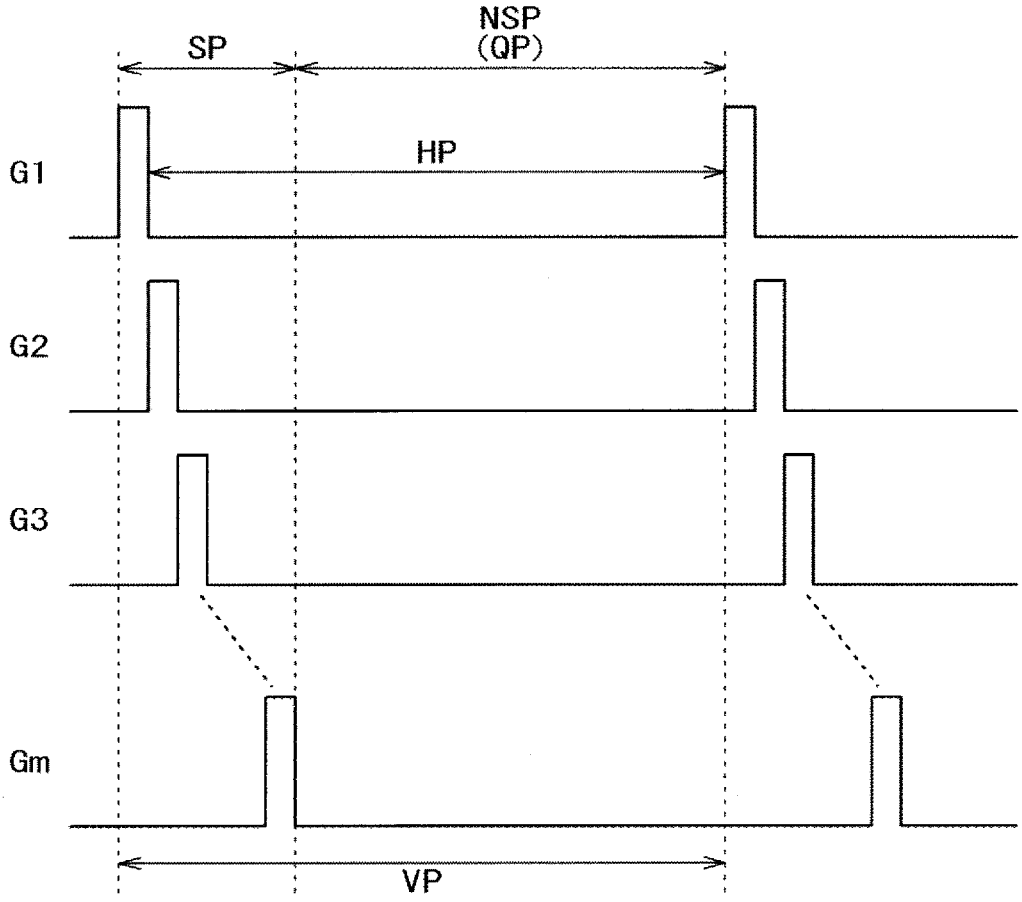
FIG. 20 is a timing chart illustrative of a driving method for the display device according to the first example.
Figure 21:
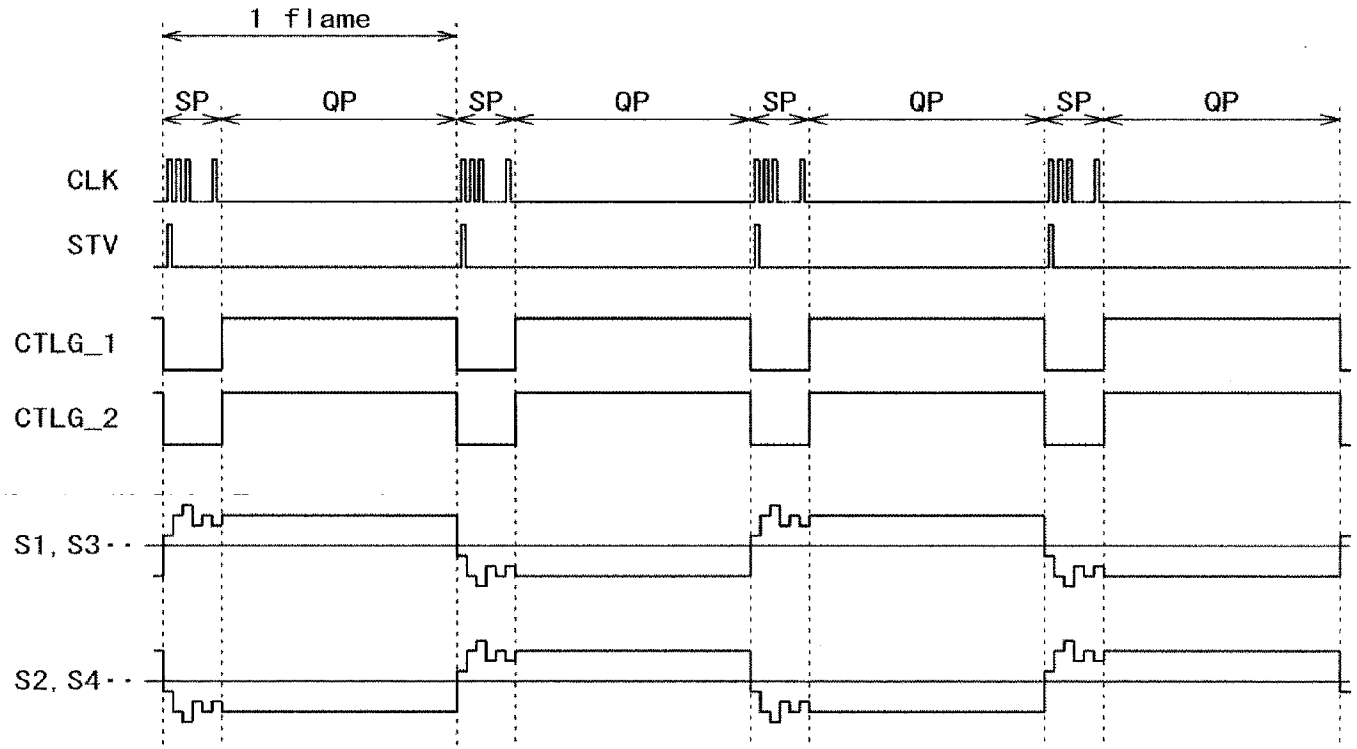
FIG. 21 is a diagram of the drive waveforms of the display device according to the first example.

FIG. 17 is a diagram of the configuration of the display device according to the first example. FIG. 18 is a block diagram of a control circuit according to the first example. FIGS. 19 and 20 are timing charts illustrative of a driving method for the display device according to the first example. FIG. 21 is a diagram of the drive waveforms of the display device according to the first example.

A display device 100A according to the first example includes a control circuit CTR, a display panel PNL, and a backlight BLT as an illuminating unit that illuminates the display panel PNL from the back face side. The display panel PNL includes an array substrate, a counter substrate, and a liquid crystal layer. The display panel PNL has a display unit AA including display pixels PX disposed in a matrix configuration. The display device 100A is a liquid crystal display device of an FFS mode in which an electric field is generated on the liquid crystal layer because of the difference between a potential applied to a counter electrode COM and a potential applied to a pixel electrode PE and the orientation direction of liquid crystal molecules included in the liquid crystal layer is controlled. The light transmission quantity of light emitted from the backlight BLT is controlled depending on the orientation direction of the liquid crystal molecules.

In the display panel PNL, the display unit AA includes a scanning line G (G1_1, G1_2, G2_1, G2_2, . . . , Gm_1, and Gm_2) extending along a row on which a plurality of the display pixels PX is arranged, a signal line S (S1, S2 . . . , Sn−1, and Sn) extending along a column on which a plurality of the display pixels PX is arranged, and a pixel switch SW disposed near the position at which the scanning line G intersects with the signal line S.

The pixel switch SW is formed of a TFT. The gate electrode of the pixel switch SW is electrically connected to the corresponding scanning line G. The source electrode of the pixel switch SW is electrically connected to the corresponding signal line S. The drain electrode of the pixel switch SW is electrically connected to the corresponding pixel electrode PE.

Here, as for the scanning line G, a row of the display pixels PX has two scanning lines, and scanning lines corresponding to the display pixels PX in the nth row are expressed by the scanning line Gm_1 and the scanning line Gm_2. The gate electrode of the pixel switch SW of the display pixel PX on an odd-numbered column is connected to the scanning line Gm_1, and the gate electrode of the pixel switch SW on the even-numbered column is connected to the scanning line Gm_2.

The display panel PNL includes a gate driver GD_1 disposed on the left side of the display unit AA, a gate driver GD_2 disposed on the right side, and a source driver SD as drive units that drive a plurality of the display pixels PX. A plurality of the scanning lines G is electrically connected to the output terminals of the gate drivers GD_1 and GD_2. In the scanning lines G, the scanning line Gm_1 is connected to the gate driver GD_1 on the left side, and the scanning line Gm_2 is connected to the gate driver GD_2 on the right side. A plurality of the signal lines S is electrically connected to the output terminal of the source driver SD.

The gate drivers GD_1 and GD_2 and the source driver SD are disposed on regions around the display unit AA. The source driver SD is formed of a semiconductor integrated circuit, and mounted on the array substrate in a COG manner. The gate drivers GD_1 and GD_2 are formed of TFTs on the array substrate. It is noted that it may be fine that the gate drivers GD_1 and GD_2 are formed of semiconductor integrated circuits and mounted on the array substrate in a COG manner as similar to the source driver SD.

The gate drivers GD_1 and GD_2 in turn apply an ON voltage to a plurality of the scanning lines G, and supply the ON voltage to the gate electrode of the pixel switch SW electrically connected to the selected scanning line G. Electricity is conducted between the source electrode and the drain electrode of the pixel switch SW whose gate electrode is supplied with the ON voltage. The source driver SD supplies output signals individually to a plurality of the corresponding signal lines S. The signal supplied to the signal line S is applied to the corresponding pixel electrode PE through the pixel switch SW that electricity is conducted between the source electrode and the drain electrode.

The operations of the gate drivers GD_1 and GD_2 and the source driver SD are controlled by the control circuit CTR disposed on the outer side of the display panel PNL. The control circuit CTR generates a counter voltage (Vcom), a gate high potential (VGH), a gate low potential (VGL), a clock signal (CLK), a start signal (STV), and a control signal (CTLG_1, CTLG_2).

The gate drivers GD_1 and GD_2 include a shift register SR and a buffer BF for the individual rows. The shift register SR has a function that transfers the start signal (STV) one by one, which is information (two-valued logic, high and low) for selecting a row corresponding to the clock signal (CLK). The buffer BF is one that amplifies the level of the output of the select state or the non-select state of the shift register SR. The buffer BF connects the scanning line G to a gate high potential (VGH) on VGH interconnections 63A and 63B when the shift register SR is selected, and connects the scanning line G to a gate low potential (VGL) on VGL interconnections 62A and 62B when the shift register SR is not selected. Thus, in the scan period described later, the VGH potential is fed to the scanning line G on the row in the select state, and the VGL potential is fed to the scanning line G on the row in the non-select state.

The control circuit CTR outputs the VGL potential. A switch GSW_1 of a p-type TFT is inserted between a VGL interconnection 61A and the VGL interconnection 62A in the display panel PNL, and a switch GSW_2 of a p-type TFT is inserted between a VGL interconnection 61B and the VGL interconnection 62B of the gate driver GD_2. The switches GSW_1 and GSW_2 are formed of TFTs on the array substrate. It is noted that it may be fine that in the case where the gate drivers GD_1 and GD_2 are formed of semiconductor integrated circuits and mounted on the array substrate in a COG manner, the switches GSW_1 and GSW_2 are formed in the inside of the gate drivers GD_1 and GD_2. The switches GSW_1 and GSW_2 can switch between connection and disconnection according to the control signals CTLG_1 and CTLG_2 inputted to the gates of the switches GSW_1 and GSW_2. When the control signals CTLG_1 and CTLG_2 are at high level, the switches GSW_1 and GSW_2 are turned OFF, and the VGL interconnections 62A and 62B are in the floating state. In the dwell period described later, although all the rows are in the non-select state (in the non-scan state), the portions above the VGL interconnections 62A and 62B are in the floating state, the VGL potential is fed, and all the scanning lines are in the floating state. The switches GSW_1 and GSW_2 correspond to the switch SW3 in FIG. 3. It is noted that the potential VGH is about 8 Vs, for example, and the potential VGL is about −7 V, for example. The high potentials of the control signals CTLG_1 and CTLG_2 are about 5 V, for example, and the low potentials are about −10 V, for example.

As illustrated in FIG. 18, the control circuit CTR mainly includes an image processing circuit 24A that controls the timing of displaying images, a timing generating circuit 24B that generates control signals for the gate drivers GD_1 and GD_2 and the source driver SD, a voltage generating circuit 24E, and an operation setting register 24C.

The image processing circuit 24A includes an input stage image processing circuit (Rx) 241 that adjusts the format of image data (RGB, BGR, and the like in data arrangement) sent from a host circuit, not illustrated, and an output stage image processing circuit (Tx) 244 that converts an image format into the image format of a driver IC interface (mini-LVDS, for example).

The timing generating circuit 24B includes a reference signal generating circuit 245 that generates an internal reference signal (SYNC) similar to a horizontal synchronization signal (HSYNC) and a vertical synchronization signal (VSYNC) from a DE signal, a horizontal counter that counts for individual dot clocks (DCLK) based on the signal SYNC and a vertical counter that counts at horizontal synchronization periods (a horizontal vertical counter 246), and a pulse generating circuit 247 that decodes the pulse durations and periods of the control signals for the gate drivers GD_1 and GD_2 and the source driver SD from the values of the horizontal vertical counter 246.

The voltage generating circuit 24E generates voltages such as VCOM, VGH, and VGL.

For the generating pulses (decode values) in the timing generating circuit 24B, the settings of operations in the image processing circuit 24A, and the settings of voltages in the voltage generating circuit 24E, a reference is made to values preset in the operation setting register 24C, and operations are determined. The register value of the operation setting register 24C is set in the circuits in the control circuit CTR by reading data written on a nonvolatile memory, for example, (an EEPROM, for example) to the register when the power supply is started.

The control circuit CTR sets the pulse interval of the start signal (STV) using the operation setting register 24C. In the case where the frame frequency for display is a general frame frequency of 60 Hz, the pulse interval of the start signal (STV) is about 16.7 msec. In this case, as illustrated in FIG. 19, one vertical period (VP) is the sum of the scan period (SP) and the vertical blanking period (VFP). Suppose that a period that is not the scan period (SP) in one vertical period is the non-scan period (NSP), the non-scan period (NSP) is a vertical blanking period (VFP).

The control circuit CTR may increase the pulse interval of the start signal (STV) to 167 msec, for example. Suppose that the scan period (SP) of one screen remains in a normal period, about nine-tenths of the pulse interval are a period in which all the scanning signal lines are in the non-scan state. As described above, the control circuit CTR can set the length of the non-scan period (NSP) after the scan period (SP) is finished and before the start signal (STV) is again inputted to the gate drivers GD_1 and GD_2, to the length of the scan period (SP) or longer. In this case, as illustrated in FIG. 20, the non-scan period (NSP) is referred to as the dwell period (QP). It is noted that the hold period (HP) is a period after the scanning line is turned to a low potential (VGL) and before the scanning line is turned to a high potential (VGH).

The control circuit CTR can set a plurality of the non-scan periods (NSP) according to the content of images. The dwell period (QP) is provided in the non-scan period (NSP), and the number of times to rewrite the screen, that is, the frequency to supply signals outputted from the source driver SD can be decreased, so that electric power to charge the pixel can be decreased.

In other words, the control circuit CTR includes a function of the intermittent driving mode for decreasing drive electric power. Suppose that for example, the standard frame frequency of the display device 100A is 60 Hz (in other words, the picture signal is rewritten to the pixel for every 1/60 sec). In the case where the moving images are displayed (in the case of a first operation mode), the display device 100A is supposed to operate at a standard frame frequency of 60 Hz. In the case where still images and the like are displayed, for which the visibility of moving images is not important so much (in the case of a second operation mode), data is written for about 1/60 sec (the screen is scanned from the top to the bottom) and then a dwell period (QP) of 1/60 sec, 3/60 sec, 7/60 sec, or 59/60 sec, for example, is provided. When the operation of the control circuit CTR is stopped in the dwell period (QP), the circuit power consumption for that period substantially becomes zero, and the average circuit power consumption including a time period when data is written can be decreased to 1/2, 1/4, 1/8, or 1/60, respectively.

As illustrated in FIG. 21, one frame includes the scan period (SP) and the dwell period (QP). The scan period (SP) is a period in which the display device is driven as similar to a typical display device, in which the start signal (STV) is transmitted through the shift registers SR by the clock signal (CLK), the output is outputted to the scanning line G in the display unit AA through the buffer BF, and the rows are selected. In the dwell period (QP), neither the start signal (STV) nor the clock signal (CLK) is operated, all the scanning lines G remain in the non-select state, and this state is held.

The buffer BF includes circuits corresponding to the switches SW1 and SW2 in FIG. 3. It is noted that when the switches SW1 and SW2 are disposed between the gate power supply circuit 7 and the switch SW3 as illustrated in FIG. 3, the switches GSW_1 and GSW_2 are necessary for the individual scanning lines G in FIG. 17. Therefore, in the first example, the switches GSW_1 and GSW_2 are disposed between the control circuit CTR and the buffer BF, and the numbers of the switches GSW_1 and GSW_2 are decreased. It is noted that in the case where the low frequency driving mode is performed, the switches GSW_1 and GSW_2 are disposed for the individual scanning lines G subsequent to the buffer BF.

Here, the control signals CTLG_1 and CTLG_2 that control the switches GSW_1 and GSW_2 are at low level in the scan period (SP). The switches GSW_1 and GSW_2 are in the conducting state, and the VGL potential from the control circuit CTR is fed to the inside of the gate drivers GD_1 and GD_2. On the other hand, in the dwell period (QP), the control signals CTLG_1 and CTLG_2 are in the high state, and the switches GSW_1 and GSW_2 are in the non-conducting state. However, in the first period (one period for the clock signal (CLK), for example) and the last period (one period for the clock signal (CLK), for example) in the dwell period (QP), the switches GSW_1 and GSW_2 are preferably in the conducting state in order to turn the potential of the gate line G to VGL. Since all the scanning lines G in the display unit AA are connected to the VGL interconnections 62A and 62B through the buffers BF in the dwell period (QP), a conductor system together including all the scanning lines G and the VGL interconnections 62A and 62B are in the floating state. Thus, the gate floating form described above is implemented, and the suppression of a flicker can be implemented.

It is noted that in the display device according to the example, a column inversion driving mode is assumed. In other words, it is a mode in which the signal lines are divided into two groups, signal lines S1, S3, S5, and so on (referred to as a first group) and signal lines S2, S4, S6, and so on (referred to as a second group) and the groups are driven at opposite polarities. With this configuration, the gate electrode of the pixel switch SW belonging to the first group is connected to the scanning line Gm_1, and the gate electrode of the pixel switch SW belonging to the second group is connected to the scanning line Gm_2, so that the first group and the second group are separately in the floating state in the dwell period (QP). The reason why this configuration is provided is as follows. In other words, as illustrated in FIG. 4, since the gate potential change when the gate electrode of the pixel switch SW is floated in the dwell period (QP) is different between the positive side and the negative side, it is desirable that the first group and the second group be formed in separate conductor systems (electrical connections are isolated) in order to obtain the effect of suppressing desired pixel potential fluctuations.

In the example, the potential of the signal line S in the dwell period (QP) is the average of the picture signal potential in the scan period (SP) immediately before. This is the setting in consideration of (a) the absolute value of the coefficient of fluctuations in the luminance is the smallest in the case where the potential is held at the same value (the same phase) as Vs when data is written in the experiment in FIG. 9. In the case of monotone images, the potential of the signal line S in the scan period (SP) is at constant, and it is fine to continuously hold the potential also in the dwell period. However, in the case where a plurality of the potential levels of the signal lines is included in one scan period, the setting of continues holding is not set, and the mean value is used for substitution.

It is noted that the mean value of the picture signal potential can be computed at the control circuit CTR. Alternatively, in the case where a computation load is large, computation is not performed, the potential level is set to the potential level of a halftone of a picture signal, and this provides a sufficient effect. For example, the potential level of the halftone is the potential level of a 127 gray scale, supposing that the maximum is a 255 gray scale.

First Exemplary Modification

A display device according to a first exemplary modification will be described with reference to FIG. 22.

Figure 22:
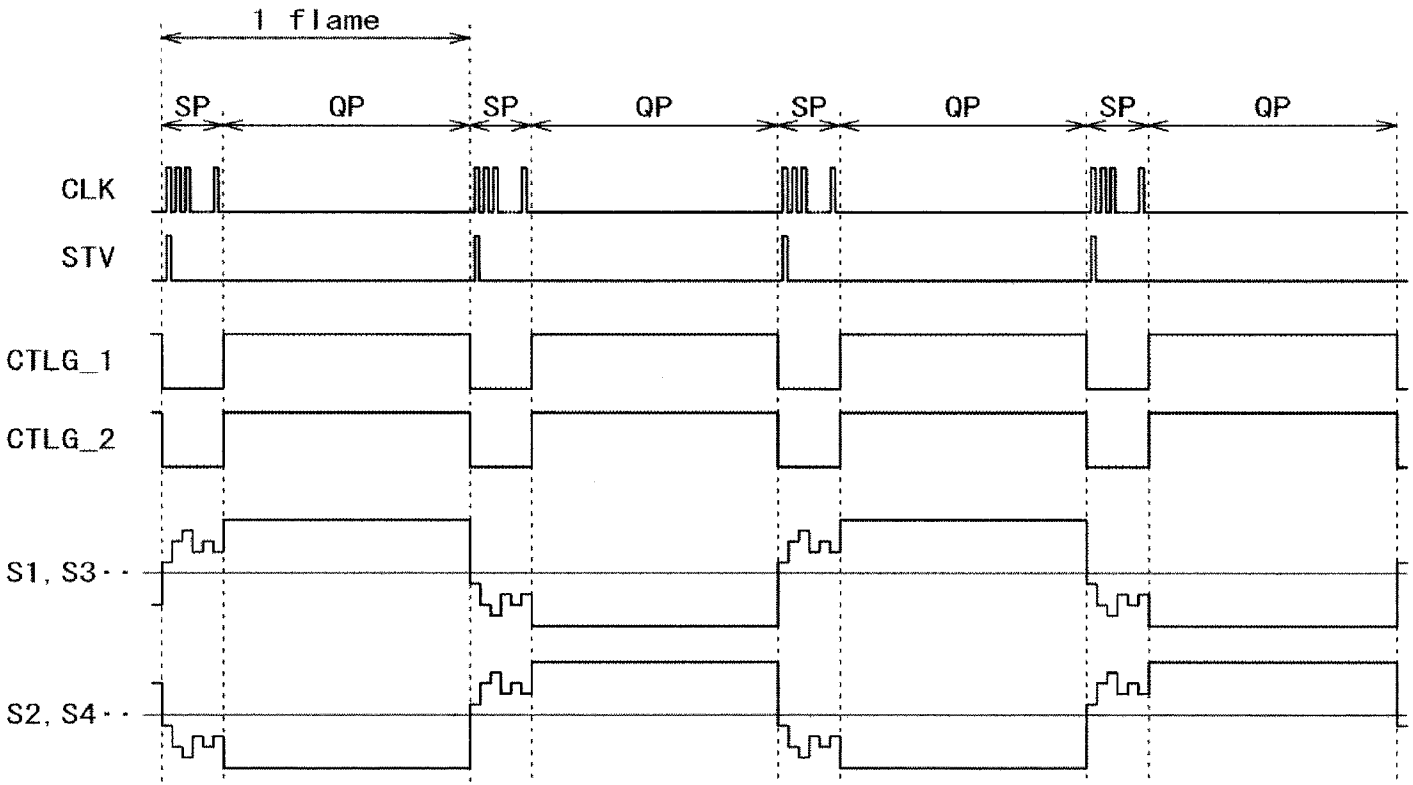
FIG. 22 is a diagram of the drive waveforms of a display device according to a first exemplary modification.

FIG. 22 is a diagram of the drive waveforms of the display device according to the first exemplary modification. The description is made in the luminance response waveforms in FIG. 12 in which in the potential of the signal line S in the dwell period (QP), the slope of the luminance change becomes gentler in order of the reversed phase, 0 V, and the same phase. However, even in the case of the same phase, the coefficient of fluctuations in the luminance does not take zero, fluctuations in the (negative) luminance remain more or less. It is estimated that this is not caused by TFTs, and this is because the leakage current is taken place on the pixel capacitance Cs, and the hold voltage on the display pixel PX is decreased. However, when the potential of the signal line S in the dwell period (QP) is held in the same phase and held in the state in which the amplitude is increased, it can be expected that the coefficient of fluctuations in the luminance is improved more than in the case of the same phase in FIG. 12.

In the display device according to the first exemplary modification, in consideration of this expectation, the potential of the signal line S in the dwell period (QP) is set to a potential greater than the average of the picture signal potential as illustrated in FIG. 22. More specifically, the potential is set to the maximum value of the picture signal potential on the positive side, and the potential is set to the minimum value of the picture signal potential on the negative side. Thus, the effect of suppressing a flicker more excellent than in the first example can be obtained.

Second Exemplary Modification

A display device according to a second exemplary modification will be described with reference to FIG. 23.

Figure 23:
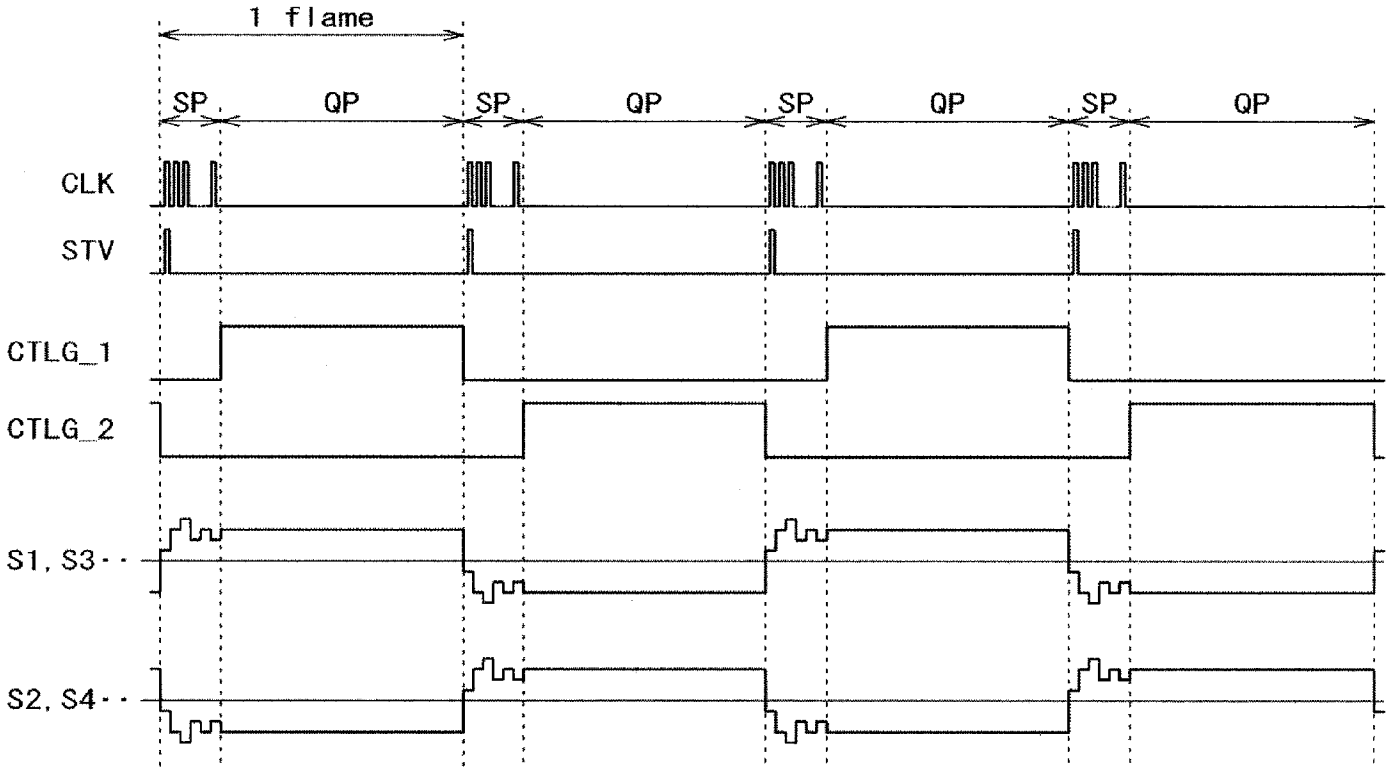
FIG. 23 is a diagram of the drive waveforms of a display device according to a second exemplary modification.

FIG. 23 is a diagram of the drive waveforms of the display device according to the second exemplary modification.

This is a realization of the third gate floating form (a form in which the gate is floated only in the positive frame and the gate potential in the dwell period is fixed in the negative frame). A control method for the control signals CTLG_1 and CTLG_2 in the dwell period (QP) is different from that in the first example. More specifically, in the dwell period in which positive signals are held on the display pixels PX in columns of a first group (signal lines S1, S3, and so on) and negative signals are held on the display pixels PX in columns of a second group (signal lines S2, S4, and so on), the control signal CTLG_1 is at high level in such a manner that scanning lines G1_1, G2_1, and so on connected to the display pixels PX holding the positive signals are floated, and the control signal CTLG_2 is at low level in such a manner that the scanning lines G1_1, G2_1, and so on connected to the display pixels PX holding the negative signals are fixed to the potential (VGL). Moreover, in the dwell period in which negative signals are held on the display pixels PX in columns of the first group (the signal lines S1, S3, and so on) and positive signals are held on the display pixels PX in columns of the second group (the signal lines S2, S4, and so on), the configurations are vice versa. Thus, as described in FIG. 13, the luminance response waveforms are nearly flat, and a flicker can be greatly improved. It is noted that in FIG. 23, the potential of the signal line S in the hold period (QP) is the case of the average of the picture signal potential in the scan period (SP) immediately before. However, any potentials may be fine such as 0 V, the potential level of the halftone of the picture signal, and a potential greater than the average of the picture signal potential. For a specific example of the potential greater than the average of the picture signal potential, the potential is the maximum value of the picture signal potential on the positive side, and the potential is the minimum value of the picture signal potential on the negative side.

Second Example

A display device according to a second example will be described with reference to FIGS. 24 and 25.

Figure 24:
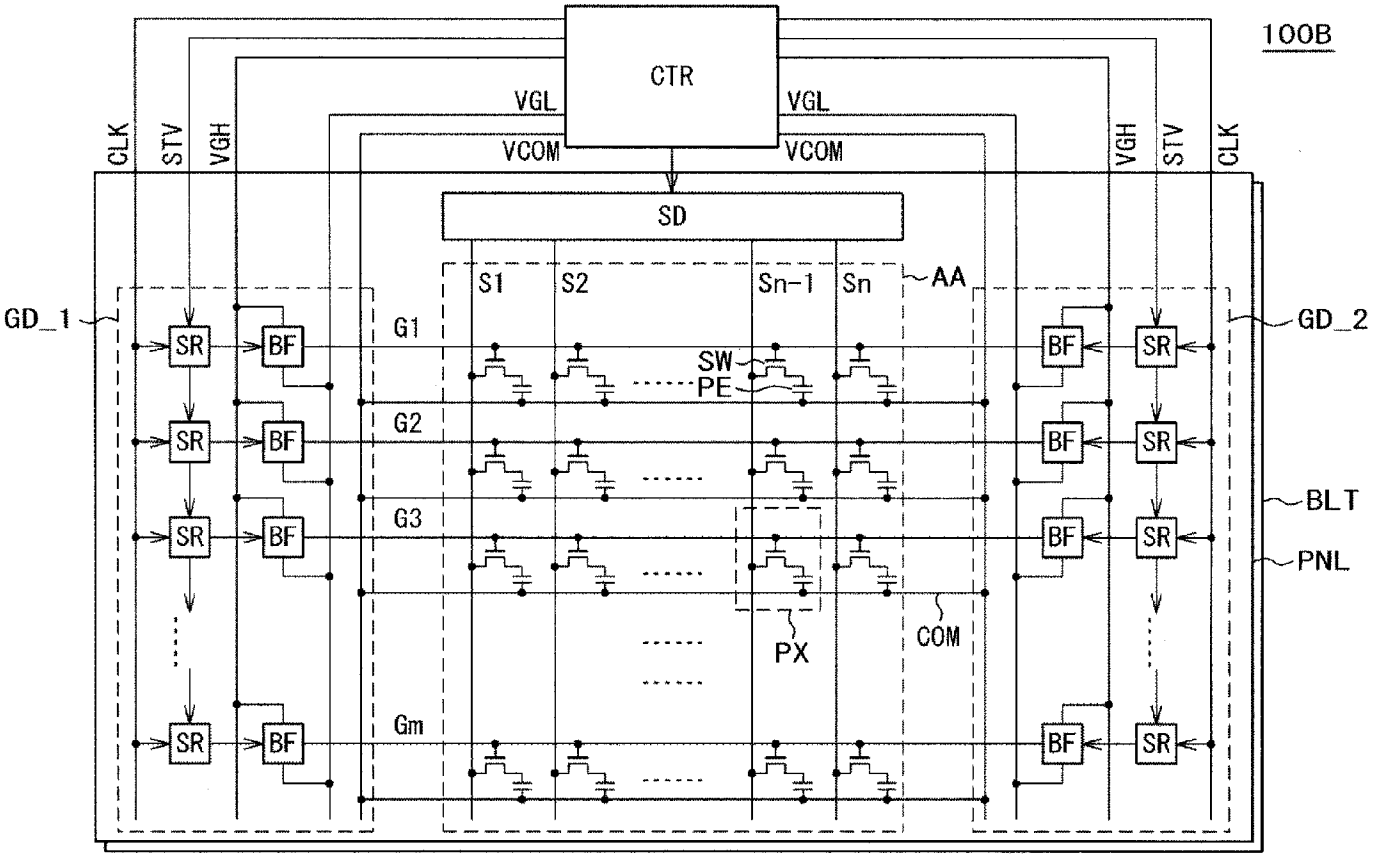
FIG. 24 is a diagram of the configuration of a display device according to a second example.
Figure 25:
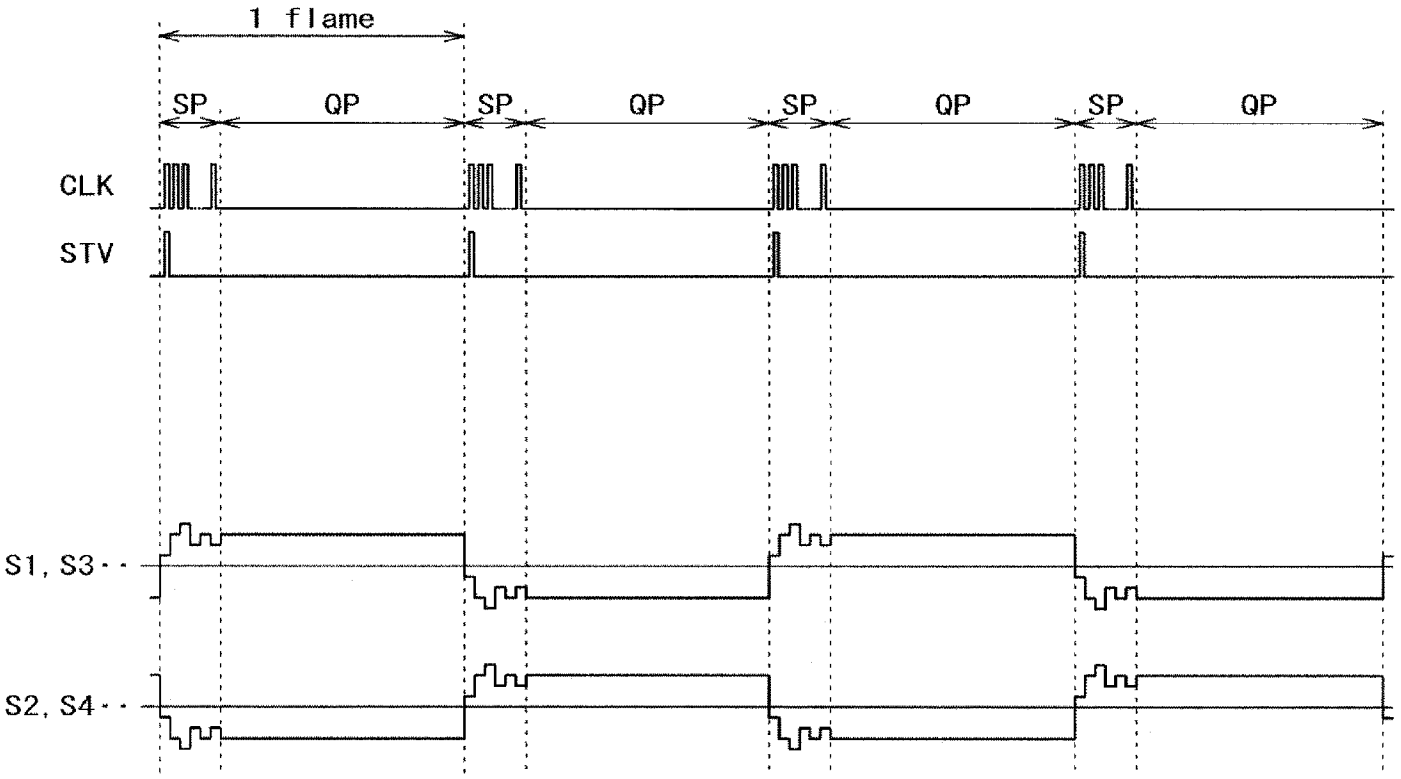
FIG. 25 is a diagram of the drive waveforms of the display device according to the second example.

FIG. 24 is a diagram of the configuration of the display device according to the second example. FIG. 25 is a diagram of the drive waveforms of the display device according to the second example.

The form is described in which the potential of the signal line S in the dwell period (QP) is set to a predetermined potential level in the display device in the gate floating form according to the first example. However, the form in which the potential of the signal line S in the dwell period (QP) is set to a predetermined potential level is also applicable to a display device 100B according to the second example, which is not in the gate floating form, and the effect of suppressing a flicker can be obtained.

The display device 100B is a display device in which the switches GSW_1 and GSW_2 are removed from the display device 100A according to the first example, the potential of a scanning line G is a fixed potential all the time, two scanning lines Gm_1 and Gm_2 in one row are not discriminated and are in common. In other words, the scanning line G is connected to both of a gate driver GD_1 disposed on the left side of a display unit AA and a gate driver GD_2 disposed on the right side. The drive waveform diagram in FIG. 24 is a diagram in which the signals (the control signals CTLG_1 and CTLG_2) that control the gates of the switches GSW_1 and GSW_2 are removed from the drive waveform diagram in FIG. 21. It is noted that in FIG. 24, the form is illustrated in which the potential of a signal line S in the dwell period (QP) is set to the average of the picture signal potential in the scan period (SP) immediately before according to the first example. However, it may be fine that the form is a form in which the potential is set to the potential level of the halftone of the picture signal according to the first example as described above and a form in which the potential is set to a predetermined potential level as described in the first exemplary modification.

The description is made above in which the leakage of the LTPS TFT includes two modes, (a) the relaxation phenomenon between the drain electrode and the gate electrode, and (b) a leakage current leaked from the drain to the source. In the example, although the effect of suppressing a flicker caused by (a) is not exerted so much, but the effect of suppressing a flicker caused by (b) can be obtained, and the example is effective to the suppression of a flicker in total. Moreover, in the example, it is unnecessary to provide two scanning lines on every row, so that a merit of improvement of the aperture ratio can be obtained as well.

What is claimed is:

1. A display device comprising:

a TFT including a gate, a source, and a drain;

a signal line connected to the source;

a pixel capacitance connected to the drain;

a first power supply configured to supply a potential that breaks electricity conducted between the source and the drain to the gate;

a second power supply configured to supply a potential that conducts electricity between the source and the drain to the gate;

a first switch configured to supply a potential of the first power supply to the gate;

a second switch configured to supply a potential of the second power supply to the gate; and a third switch located between the first switch, the second switch, and the gate, wherein:

the display device has a scan period, in which one screen is scanned, and a dwell period between the scan period and a subsequent scan period, the dwell period being the same as or longer than the scan period;

in the scan period, either one of the first switch and the second switch is turned on to supply one of the potentials of the first and second power supplies to the gate, so that the potential of the gate is fixed;

in the dwell period, the third switch is turned off so that none of the potentials of the first and second power supplies are supplied to the gate, so that the potential of the gate is floated, and when a potential of the signal line is a positive polarity, the third switch is turned off in the dwell period, and when a potential of the signal line is a negative polarity, the first switch is turned on in the dwell period.

2. The display device according to claim 1, wherein in the dwell period, a potential of the signal line is set to a predetermined potential other than 0 V at a polarity the same as a polarity of the signal line in a scan period immediately before.

3. The display device according to claim 2, wherein in the dwell period, a potential of the signal line is set to an average of a picture signal potential in a scan period immediately before.

4. The display device according to claim 2, wherein in the dwell period, a potential of the signal line is set to an intermediate value between a maximum value and a minimum value of a picture signal potential.

5. The display device according to claim 2, wherein in the dwell period, a positive potential of the signal line is set greater than an average of a picture signal potential in a scan period immediately before, and a negative potential of the signal line is set smaller than the average of the picture signal potential in the scan period immediately before.

6. The display device according to claim 2, wherein in the dwell period, a positive potential of the signal line is set to a maximum value of a picture signal potential, and a negative potential of the signal line is set to a minimum value of the picture signal potential.

* * * * *